US009283743B2

(12) United States Patent
Schaede et al.

(10) Patent No.: US 9,283,743 B2
(45) Date of Patent: Mar. 15, 2016

(54) PRINTING PRESS FOR NUMBERING AND VARNISHING OF SECURITY DOCUMENTS, INCLUDING BANKNOTES

(75) Inventors: Johannes Georg Schaede, Wurzberg (DE); Matthias Gygi, Schmitten (CH)

(73) Assignee: KBA-NotaSys SA, Lausanne (CH)

( * ) Notice: Subject to any disclaimer, the term of this patent is extended or adjusted under 35 U.S.C. 154(b) by 509 days.

(21) Appl. No.: 13/698,934

(22) PCT Filed: May 12, 2011

(86) PCT No.: PCT/IB2011/052093

§ 371 (c)(1),
(2), (4) Date: Mar. 26, 2013

(87) PCT Pub. No.: WO2011/145028

PCT Pub. Date: Nov. 24, 2011

(65) Prior Publication Data

US 2013/0213246 A1 Aug. 22, 2013

(30) Foreign Application Priority Data

May 19, 2010 (EP) ..... 10163327
May 19, 2010 (EP) ..... 10163336

(51) Int. Cl.
*B41F 11/02* (2006.01)
*B41F 21/08* (2006.01)
(Continued)

(52) U.S. Cl.
CPC ..... *B41F 11/02* (2013.01); *B41F 21/08* (2013.01); *B41F 21/10* (2013.01); *B41F 23/044* (2013.01);
(Continued)

(58) Field of Classification Search
CPC ..... B41F 11/02; B41F 21/08; B41F 23/0443; B41F 23/08; B41F 31/302; B41F 33/0036
USPC ..... 101/72, 76, 424.1, 424.2
See application file for complete search history.

(56) References Cited

U.S. PATENT DOCUMENTS 4,830,902 A 5/1989 Plantenga et al.
6,338,299 B1 1/2002 Kamoda et al.
(Continued)

FOREIGN PATENT DOCUMENTS

CA 2446559 11/2002
EP 0 256 170 2/1988
(Continued)

OTHER PUBLICATIONS

International Search Report for PCT/IB2011/052093, mailed Jul. 21, 2011.
(Continued)

*Primary Examiner* — Leslie J Evanisko
(74) *Attorney, Agent, or Firm* — Nixon & Vanderhye P.C.

(57) ABSTRACT

There is described a sheet-fed or web-fed printing press for numbering and varnishing of security documents, including banknotes, comprising: —a numbering group (02) comprising at least one numbering unit (21, 22) for numbering printed material in the form of individual sheets or successive portions of a continuous web carrying multiple security imprints; and—a varnishing group (03; 03*) located downstream of the numbering group (02) for applying varnish onto recto and verso sides of the printed material, the varnishing group (03; 03*) comprising at least a first varnishing unit (31) disposed above a path of the printed material to apply varnish on the recto side of the printed material and at least a second varnishing unit (32) disposed below the path of the printed material to apply varnish on the verso side of the printed material.

37 Claims, 4 Drawing Sheets

(51) Int. Cl.

| | |
|---|---|
| ***B41F 21/10*** | (2006.01) |
| ***B41F 23/04*** | (2006.01) |
| ***B41F 23/08*** | (2006.01) |
| ***B41F 31/30*** | (2006.01) |
| ***B41F 33/00*** | (2006.01) |
| ***B65H 29/04*** | (2006.01) |
| *B41M 7/02* | (2006.01) |
| *B41M 7/00* | (2006.01) |

(52) U.S. Cl.

CPC ..... *B41F 23/0409* (2013.01); *B41F 23/08* (2013.01); *B41F 31/302* (2013.01); *B41F 33/0036* (2013.01); *B65H 29/042* (2013.01); *B41M 7/0081* (2013.01); *B41M 7/02* (2013.01); *B41P 2217/11* (2013.01); *B65H 2301/1321* (2013.01); *B65H 2301/517* (2013.01); *B65H 2301/5111* (2013.01); *B65H 2301/5114* (2013.01); *B65H 2301/5144* (2013.01); *B65H 2402/10* (2013.01); *B65H 2601/321* (2013.01); *B65H 2701/1912* (2013.01); *B65H 2801/31* (2013.01)

(56) References Cited

U.S. PATENT DOCUMENTS

| | | | |
|---|---|---|---|
| 2002/0127339 | A1 | 9/2002 | Schwitzky et al. |
| 2004/0069169 | A1 | 4/2004 | Demaimay et al. |
| 2006/0043729 | A1 | 3/2006 | Schwitzky et al. |
| 2006/0208412 | A1 | 9/2006 | Reinhard et al. |
| 2006/0213384 | A1 | 9/2006 | Reinhard et al. |
| 2009/0003656 | A1 | 1/2009 | Reinhard et al. |
| 2009/0038490 | A1 | 2/2009 | Gygi |
| 2009/0095178 | A1 | 4/2009 | Schwitzky et al. |
| 2009/0101030 | A1 | 4/2009 | Stohr et al. |
| 2010/0089261 | A1 | 4/2010 | Schwitzky |
| 2010/0139463 | A1 | 6/2010 | Schaede |
| 2011/0146510 | A1 | 6/2011 | Bolognini |

FOREIGN PATENT DOCUMENTS

| | | |
|---|---|---|
| EP | 0 976 555 | 2/2000 |
| EP | 1 932 678 | 6/2008 |
| EP | 1 958 769 | 8/2008 |
| EP | 1 980 393 | 10/2008 |
| WO | WO 01/08899 | 2/2001 |
| WO | WO 02/051638 | 7/2002 |
| WO | WO 02/094577 | 11/2002 |
| WO | WO 2005/008605 | 1/2005 |
| WO | WO 2005/008606 | 1/2005 |
| WO | WO 2006/021856 | 3/2006 |
| WO | WO 2006/129245 | 12/2006 |
| WO | WO 2007/060624 | 5/2007 |
| WO | WO 2010/023598 | 3/2010 |

OTHER PUBLICATIONS

Buitelaar et al., "Effects of Banknote varnishing", *Currency Conference CSI*, 1999, 4 pages.

de Heij et al., "The design methodology of Dutch banknotes", *IS&T/SPIE's 12 International Syposium of Electronic Imaging* . . . , Jan. 2000, Proceedings of SPIE vol. 3973, pp. 2-22.

Wettstein et al., "Life cycle assessment (LCA) of Swiss banknotes", *Quarterly Bulletin Mar. 2000 of the Swiss National Bank*, Sep. 2000, 15 pages.

Buitelaar et al., "Circulation Fitness Management", *Banknote 2003 Conference*, Feb. 2003, 54 pages.

PRINTING PRESS FOR NUMBERING AND VARNISHING OF SECURITY DOCUMENTS, INCLUDING BANKNOTES

This application is the U.S. national phase of International Application No. PCT/IB2011/052093 filed 12 May 2011 which designated the U.S. and claims priority to EP Patent Application Nos. 10163327.9 filed 19 May 2010 and 10163336.0 filed 19 May 2010, the entire contents of each of which are hereby incorporated by reference.

PREAMBLE

Technical Field

The present invention generally relates to a sheet-fed or web-fed printing press for numbering and varnishing of security documents, including banknotes.

BACKGROUND OF THE INVENTION

Numbering presses for numbering sheets of securities, or as the case may be a continuous web of securities, are known in the art. International Publications Nos. WO 2006/129245 A2 and WO 2007/060624 A1, both in the name of the present Applicant and incorporated herein by reference in their entirety, for instance disclose such numbering presses.

Varnishing of banknotes was and is especially carried out to increase the durability and life-cycle of banknotes put into circulation. Information about the varnishing of banknotes can for instance be found in the following papers:

[Buitelaar1999]:

Tom Buitelaar, De Nederlandsche Bank NV, Amsterdam, the Netherlands, "Effects of Banknote varnishing", Currency Conference CSI, Sydney 1999;

[deHeij2000]:

Hans A. M. de Heij, De Nederlandsche Bank NV, Amsterdam, the Netherlands, "The design methodology of Dutch banknotes", IS&T/SPIE's 12$^{th}$ International Symposium on Electronic Imaging, Optical Security and Counterfeit Deterrence Techniques III, San José, Calif., USA (Jan. 27-28, 2000), Proceedings of SPIE vol. 3973, pp. 2-22;

[Wettstein2000]:

Frank Wettstein, Cash Division, Swiss National Bank, Berne and Hubert Lieb, Environmental Unit, Swiss National Bank, Zurich, "Life cycle assessment (LCA) of Swiss banknotes", Quarterly Bulletin 3/2000 of the Swiss National Bank, September 2000;

[Buitelaar2003]:

Tom Buitelaar, De Nederlandsche Bank NV, Amsterdam, the Netherlands, "Circulation Fitness Management", Banknote 2003 Conference, Washington D.C., Feb. 3, 2003;

Further information about the varnishing of banknotes and like security documents might be found in European Patent Publications Nos. EP 0 256 170 A1, EP 1 932 678 A1 and International Publications Nos. WO 01/08899 A1, WO 02/094577 A1, and WO 2006/021856 A1.

Varnishing presses for varnishing sheets or a continuous web of securities are also known in the art. International Publications Nos. WO 02/051638 A1 and WO 2010/023598 A1, and European Patent Publication No. EP 0 976 555 A1 for instance disclose such varnishing presses.

WO 02/051638 A1 specifically discloses a stand-alone flexographic printing press which can be used for varnishing of banknotes comprising at least a first flexographic unit disposed above the path of the sheets for cooperation with a recto side of the sheets and at least a second flexographic unit disposed downstream of the first flexographic unit and below the path of the sheets for cooperation with a verso side of the sheets. According to WO 02/051638 A1, the two flexographic units are separated by at least two intermediate cylinders and the second flexographic unit is offset in height with respect to the first flexographic unit.

EP 0 976 555 A1 specifically discloses a sheet-fed coating system consisting of multiple coating units disposed one after the other along the path of the sheets, the coating units being located both above and below the path of the sheets. According to EP 0 976 555 A1, such coating system can be coupled directly after a conventional offset printing group or combined with additional offset printing units. There is however no disclosure or suggestion in this document regarding the coupling of the coating system to a numbering group.

All of the configurations envisaged in EP 0 976 555 A1 share a generally similar configuration with multiple printing or coating towers disposed one after the other along the path of the sheets, which configuration is similar to that of conventional printing presses used for non-security applications and requires a rather considerable footprint. More precisely, all these configurations make use of a series of transfer cylinders against the circumference of which the recto and verso sides of the sheets are alternately brought into contact, which solution thus necessitates intermediate drying of the sheets after each printing operation, before the sheets are transferred to the downstream located transfer cylinder. Such solution is inadequate for the application of oxidative solvent-based inks as drying times are too short with such configurations for the oxidative solvent-based inks to be dried before transfer of the sheet to the downstream located transfer cylinder.

SUMMARY OF THE INVENTION

A general aim of the invention is to provide a sheet-fed or web-fed printing press that suitably combines numbering and varnishing in a single pass.

A further aim of the invention is to provide such a printing press that is as compact as possible, while still ensuring ease of maintenance of and proper accessibility to the various components of the numbering and varnishing groups.

Yet another aim of the invention is to provide such a printing press that is suitable for varnishing printed material which is numbered with oxidative solvent-based inks and UV-curable inks.

These aims are achieved thanks to the printing press defined in the claims.

There is accordingly provided a sheet-fed or web-fed printing press for numbering and varnishing of security documents, including banknotes, comprising:

- a numbering group comprising at least one numbering unit for numbering printed material in the form of individual sheets or successive portions of a continuous web carrying multiple security imprints; and
- a varnishing group located downstream of the numbering group for applying varnish onto recto and verso sides of the printed material, the varnishing group comprising at least a first varnishing unit disposed above a path of the printed material for applying varnish on the recto side of the printed material and at least a second varnishing unit disposed below the path of the printed material for applying varnish on the verso side of the printed material.

According to a preferred embodiment of the printing press which is adapted for processing printed material in the form of individual sheets, the printing press further comprises:

a sheet-feeder for feeding individual sheets in succession to the numbering group; and a sheet-delivery system for collecting varnished sheets coming from the varnishing group, the numbering group being coupled to the varnishing group by means of an intermediate sheet gripper system comprising endless chains and space-apart gripper bars mounted transversely to the path of the sheets, between the endless chains, for holding the sheets by a leading edge of the sheets and transporting the sheets from the numbering group to the varnishing group.

There is further provided a sheet-fed printing press for numbering and varnishing of security documents, including banknotes, comprising:

a sheet-feeder for feeding in succession printed material in the form of individual sheets carrying multiple security imprints;

a numbering group comprising at least one numbering unit for numbering the sheets;

a varnishing group located downstream of the numbering group for applying varnish onto recto and verso sides of the sheets, the varnishing group comprising at least a first varnishing unit for applying varnish on the recto side of the sheets and at least a second varnishing unit for applying varnish on the verso side of the sheets; and a sheet-delivery system for collecting varnished sheets coming from the varnishing group, wherein the numbering group is coupled to the varnishing group by means of an intermediate sheet gripper system comprising endless chains and space-apart gripper bars mounted transversely to the path of the sheets, between the endless chains, for holding the sheets by a leading edge of the sheets and transporting the sheets from the numbering group to the varnishing group.

According to an advantageous variant of the above printing presses comprising the intermediate sheet gripper system, the numbering group further comprises a movable carriage, preferably a movable inking carriage, that can be retracted away from or be coupled to a stationary part of the numbering group. In such a case, the intermediate sheet gripper system advantageously runs below the movable carriage.

The printing presses of the invention are preferably designed in such a way that numbering is carried out in the numbering group on a recto side of the printed material (the "numbered side") and that the numbered printed material is transferred directly to the varnishing group for varnishing of the recto side of the printed material by the at least first varnishing unit and, immediately after varnishing of the recto side, for varnishing of the verso side of the printed material (the side opposite the "numbered side") by the at least second varnishing unit. This is especially advantageous in that intermediate drying of the recto side of the printed material (the "numbered side"), before the printed material is varnished, is not critical and may potentially be omitted. Indeed, the numbered side is varnished first which in effect seals the surface of the printed material with a layer of varnish and thereby protects the numbering lying below the layer of varnish. Tests carried out by the Applicant have further demonstrated that contamination of the first varnishing unit by (still wet) oxidative solvent-based ink applied during the numbering operation does not occur thanks to the ink split that takes place at the first varnishing unit.

Further advantageous embodiments of the invention form the subject-matter of the dependent claims and are discussed below.

BRIEF DESCRIPTION OF THE DRAWINGS

Features and advantages of the present invention will appear more clearly from reading the following detailed description of embodiments of the invention which are presented solely by way of non-restrictive examples and are illustrated by the attached drawings in which.

DETAILED DESCRIPTION OF EMBODIMENTS OF THE INVENTION

A preferred embodiment of the invention will be described in reference to FIGS. 1 and 2 which illustrate a sheet-fed printing press. It shall however be understood that the present invention is equally applicable to web-fed printing presses. The invention therefore applies to the processing of any printed material which is in the form of individual sheets or successive portions of a continuous web.

Figure 1:
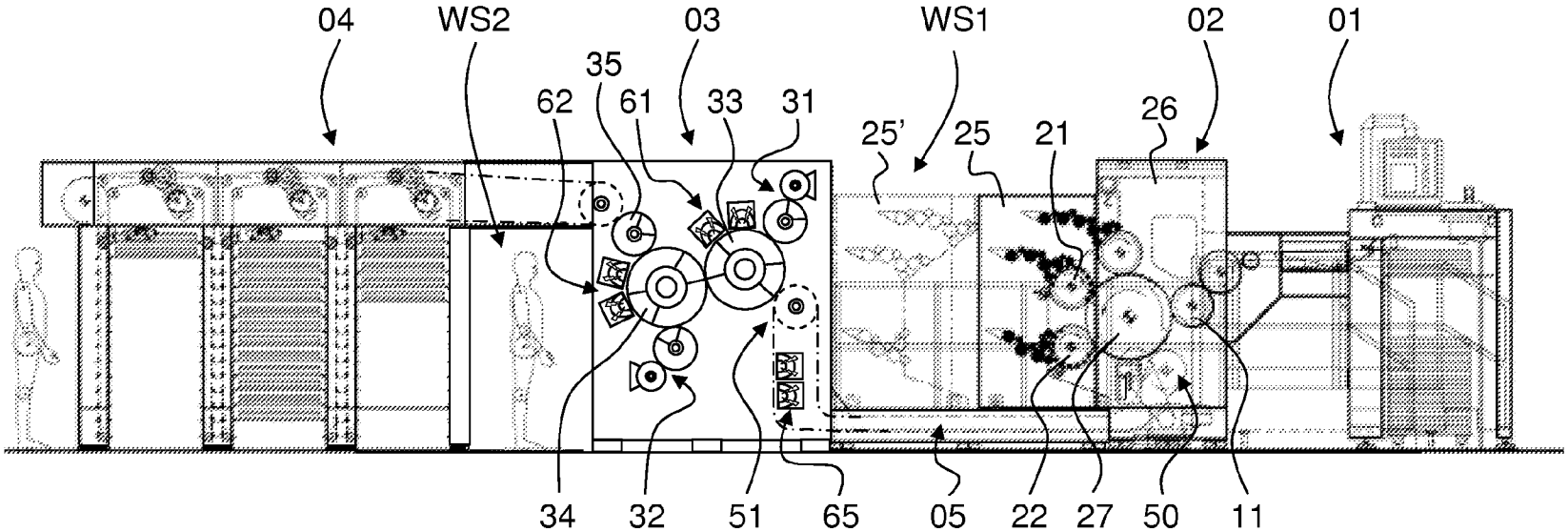
FIG. 1 is a schematic side view of a printing press according to a preferred embodiment of the invention.

FIG. 1 is a schematic side view of the preferred embodiment of the printing press which includes in this example a sheet-feeder 01 for feeding individual sheets in succession, which sheets carry multiple security imprints that are typically arranged in the form of a matrix. These sheets are first fed to a numbering group 02 which comprises at least one numbering unit for numbering the sheets and then from the numbering group 02 to a downstream located varnishing group 03 for applying varnish onto recto and verso sides of the sheets. To this end, the varnishing group 03 comprises at least a first varnishing unit 31 for applying varnish on the recto side of the sheets and at least a second varnishing unit 32 for applying varnish on the verso side of the sheets. The first and second varnishing units 31, 32 are respectively disposed above and below the path of the sheets.

Once varnished on the recto and verso sides, the sheets are transferred to a sheet-delivery system 04 known as such in the art which collects the varnished sheets coming from the varnishing group 03.

The numbering group 02 and varnishing group 03 are advantageously coupled to one another by means of an intermediate sheet gripper system 05 comprising space-apart gripper bars for holding the sheets by a leading edge thereof and transporting the sheets from the numbering group 02 to the varnishing group 03. This intermediate sheet gripper system 05 consists of endless chains disposed between pairs of chain wheels located at upstream 50 and downstream ends 51, the endless chains being constantly driven during operation (in this example in the clockwise direction). Gripper bars (not shown) are mounted transversely to the path of the sheets between the chains and at constant intervals to suitably take sheets away from the numbering group 02 to deliver those to the downstream-located varnishing group 03.

An advantage of the intermediate sheet gripper system 05 resides in the fact that the freshly printed side (hereinafter referred to as being the recto side) of the sheets which have been numbered in the numbering group 02 is not brought into contact with any surface before being brought to varnishing group 03, thereby avoiding any smearing or like printing quality issues.

The numbering group 02 is as such identical to the numbering group disclosed in International Publications Nos. WO 2006/129245 A2 and WO 2007/060624 A1, both in the name of the present Applicant. The disclosure thereof is incorporated herein by reference. The configuration of the numbering group 02 will not therefore be described in detail here as one can refer to the above-listed International Publications. It suffice to understand that this numbering group 02 comprises a stationary part 26 (or printing unit) housing in particular a transport cylinder 27 (or impression cylinder) which transports the sheets being supplied from the sheet-feeder 01 by an upstream located transfer cylinder (or drum as the case may be) 11. The transport cylinder 27, which rotates in this example in the counter-clockwise direction, transports the sheets past first and second numbering units 21, 22. An optional printing unit (not referenced) is provided upstream of the first printing unit 21. Once numbered, the sheets are taken away from the transport cylinder 27 at the upstream end 50 of the intermediate sheet gripper system 05. Numbering takes place in the numbering group 02 by way of typographic (or letterpress) printing using oxidative solvent-based inks or UV-curable inks.

As illustrated in FIG. 1, the numbering group 02 preferably comprises a mobile carriage 25 (which acts in this case as an inking carriage) that can be retracted away from or be coupled to the stationary part 26 of the numbering group 02. Reference numeral 25 designates the mobile carriage (which is depicted in continuous lines in FIG. 1) in a working position, i.e. coupled to the stationary part 26, while reference numeral 25' designates the mobile carriage (which is depicted in dashed lines in FIG. 1) in a maintenance position, i.e. retracted away from the stationary part 26.

It will be appreciated that FIG. 1 shows that the intermediate sheet gripper system 05 runs below the movable carriage 25, 25' which ensures that maintenance operations and access to the numbering group 02 are not compromised. Indeed, space is provided between the numbering group 02 and the varnishing group 03 to ensure that the movable carriage 25 can be retracted to its maintenance position 25'.

The numbering group 02 and varnishing group 03 are preferably constructed as modular groups that can easily be decoupled from one another. Even more preferably, transfer of a sheet from the intermediate sheet gripper system 05 to the varnishing group 03 is performed at a location which corresponds in height to a location where the sheet is transferred from the transfer cylinder or drum 11 to the transport cylinder 27 of the numbering group 02. In this way, the varnishing group 03 can potentially be coupled directly to the sheet in-feed system (i.e. downstream of the transfer cylinder 11) should it be needed to omit the numbering group 02. The varnishing group 03 is accordingly designed and configured as an independent module which can potentially be used independently of the numbering group 02.

Figure 2:
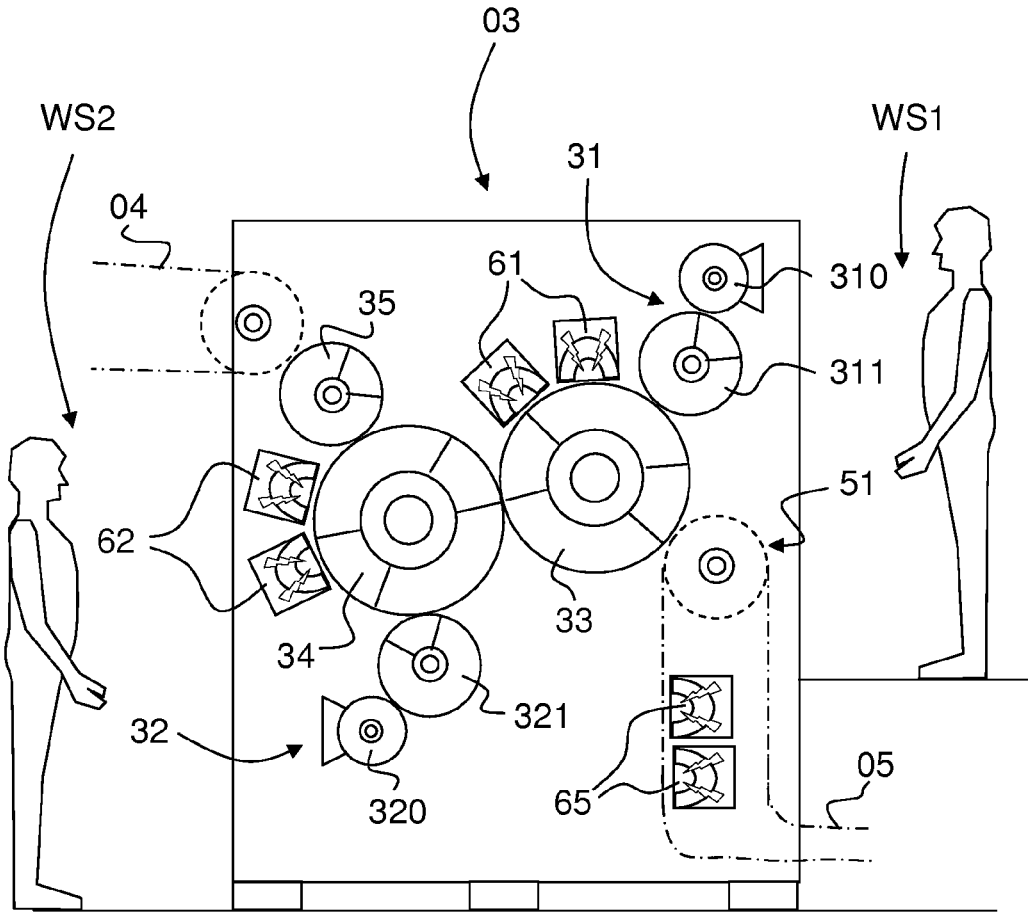
FIG. 2 is an enlarged schematic side view of the varnishing group of the printing press of FIG. 1.

FIG. 2 illustrates in greater detail the varnishing group 03 of the printing press of FIG. 1. It shows in particular a first cylinder or drum 33 located below the path of the sheets and cooperating with the first varnishing unit 31 which is disposed above the path of the sheets. It further shows a second cylinder or drum 34 located above the path of the sheets and cooperating with the second varnishing unit 32 which is disposed below the path of the sheets, which second cylinder or drum 34 is located immediately after the first cylinder or drum 33 to ensure direct transfer of the sheets from the first cylinder or drum 33 to the second cylinder or drum 34. As illustrated, the first and second cylinders or drums 33, 34 are preferably designed as two-segment cylinders or drums, similarly to the impression cylinder 27 of the numbering group 02.

The first and second varnishing units (and additional varnishing units that may be provided if necessary) are preferably flexographic units consisting of an anilox roller 310, respectively 320, which is inked by an associated ink chamber (not referenced) and which cooperates with an associated forme cylinder 311, respectively 321, that carries a flexographic printing plate. This printing plate can be designed to apply varnish over substantially all of the corresponding side of the sheets or, as the case may be, to apply varnish only on selected areas of the sheets, in which latter case the flexographic printing plate is provided with corresponding ink transferring areas.

A transfer cylinder or drum 35 is provided to suitably transfer the sheets from the second cylinder 34 to the sheet-delivery system 04, which sheet-delivery system 04 transports the sheets in the clockwise direction in this example. This transfer cylinder or drum 35 may be omitted should the sheet-delivery system 04 be designed to transport the sheets in the counter-clockwise direction, or additional transfer cylinders or drums may be provided if necessary (as shown for instance in FIG. 3). These transfer cylinders or drums, including the transfer cylinder or drum 35, may for instance be used to carry out inspection of the recto and/or verso sides of the printed material. In addition, one or more transfer cylinders or drums may be designed as chill rollers to cool down the temperature of the printed material which is typically heated as a result of the action of drying units.

At least a first drying unit 61 is further provided for drying the recto side of the sheets following varnishing by the first varnishing unit 31 and prior to transfer of the printed material to the second cylinder or drum 34. Similarly, at least a second drying unit 62 for drying the verso side of the sheets following varnishing by the second varnishing unit 32 is provided. These drying units 61, 62 preferably include UV-curing units in case of varnishing using UV-curable varnishes, which type of varnish is preferably used in the context of the present invention.

An intermediate UV-curing unit 65 (shown in FIGS. 1 and 2) is also provided along the path of the sheets between the numbering group 02 and varnishing group 03 for curing the sheets which have been numbered on the numbering group 02 in case numbering is carried out using UV-curable inks. Such intermediate UV-curing unit 65 may however be omitted.

Figure 3:
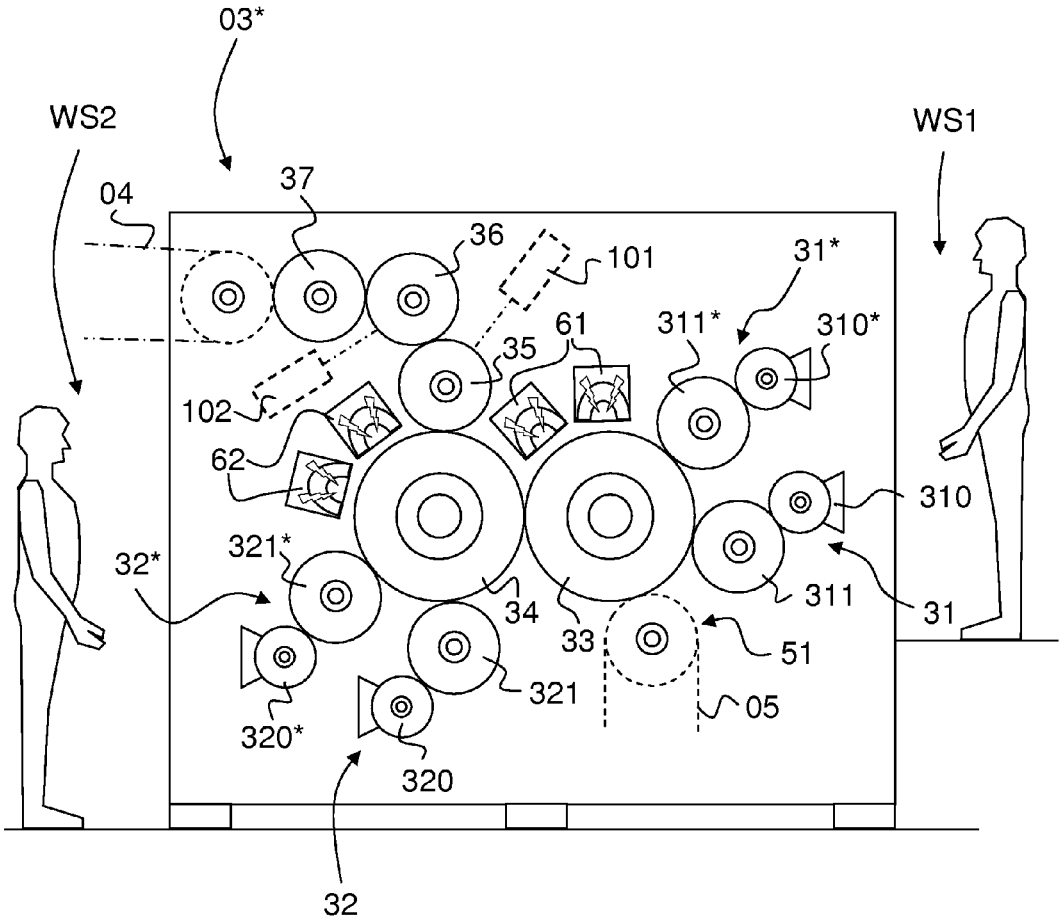
FIG. 3 is a schematic side view of a varnishing group according to another embodiment of the invention.

FIG. 3 illustrates another embodiment of a varnishing group, designated generally by reference numeral 03*, that could be used in lieu of the varnishing group 03 of FIGS. 1 and 2. Such varnishing group 03* similarly includes first and second cylinders or drums 33, 34 respectively located below and above the path of the sheets and cooperating respectively with first and second varnishing units 31, 32 of the same type as in FIGS. 1 and 2. The orientation of the first and second cylinders or drums 33, 34 has been adapted to allow for the provision of third and fourth varnishing units 31*, 32* (each comprising an anilox 310*, 320* inked by an associated ink chamber and a flexographic forme cylinder 311*, 321* carrying a flexographic plate) cooperating respectively with the first and second cylinders or drums 33, 34 as illustrated. In other words, two varnishing units 31, 31*, respectively 32, 32* are provided for varnishing each side of the sheets.

Such solution allows for greater flexibility in terms of varnishing. For instance, one varnishing unit (e.g. unit 31 or 32) could be used to apply a primer, while the second varnishing unit (e.g. unit 31* or 32*) could be used to apply a layer of varnish on top of the primer. The two varnishing units on each side could furthermore be used to apply two different types of varnishes or to apply invisible features, such as fluorescent features. Such solution could in particular be convenient in the context of the application disclosed in International Publication No. WO 2010/023598 A1.

A UV-curing unit 61 is similarly provided to cure the UV-curable varnish(es) applied by varnishing units 31, 31* on the recto side of the sheets, before being transferred to the second cylinder or drum 34, a second UV-curing unit 62 being provided downstream of varnishing units 32, 32* in order to cure the UV-curable varnish(es) applied on the verso side of the sheets before these are taken away from the second cylinder or drum 34.

Operation of the varnishing group 03* of FIG. 3 is similar to that of the varnishing group 03 discussed in reference to FIGS. 1 and 2, namely the printed sheets are transferred from the numbering group 02 to the first cylinder or drum 33 for varnishing of the recto side of the sheets (i.e. the side that was numbered) and then immediately to the downstream located cylinder or drum 34 for varnishing of the verso side of the sheets.

Once varnished on the verso side, the sheets are transferred to a first transfer cylinder or drum 35 where the recto side can be inspected, if necessary, by means of an optional camera 101. In this other embodiment, two additional (and optional) transfer cylinders or drums 36, 37 are interposed between the first transfer cylinder or drum 35 and the sheet-delivery system 04. The second transfer cylinder 36 can be used to carry out an inspection, if necessary, of the verso side of the sheets by means of an optional camera 102. The third transfer cylinder 37 is necessary to ensure proper transfer of the sheets to the downstream located sheet-delivery system 04 and could be designed as a chill roller to cool down the sheets which have been processed in the varnishing group 03*.

According to the above-discussed embodiments of the invention, one will appreciate that numbering is preferably carried out in the numbering group 02 on a recto side of the printed material (i.e. the side facing upwards in the illustrations of FIGS. 1 to 3) and that the numbered printed material is transferred directly to the varnishing group 03, 03* for varnishing of the recto side of the printed material by the first varnishing unit 31 (and optional additional varnishing unit(s)) and, immediately after varnishing of the recto side, for varnishing of the verso side (i.e. the side facing downwards in the illustrations of FIGS. 1 to 3) of the printed material by the second varnishing unit 32 (and optional additional varnishing unit(s)). In other words, the numbered side is varnished first, followed by the unnumbered side, and the numbered side is not brought into contact with any element or surface before varnishing thereof which could negatively affect printing quality.

While intermediate drying of the numbering, before varnishing, is preferred, tests carried out by the Applicant have demonstrated that an intermediate drying (or curing) is not critical and may be omitted as the numbering is covered by a layer of varnish which is immediately cured by the first drying unit 61. This is especially useful in case oxidative solvent-based inks are used for the numbering of the printed material. In case UV-curable inks are used for the numbering of the printed material, the UV-curing unit 65 may however be convenient as this ensures that the UV-curable ink of the numbering will not interfere with or negatively affect the properties of the varnish applied on the sheets.

Indeed, thanks to the proposed configuration, at least one layer of varnish can be applied on the numbered side of the sheets by means of the first varnishing unit 31. Thanks to the ink split that takes place between the forme cylinder 311 and the surface of the sheets that are transported by the first cylinder or drum 33, the numbered side is in effect sealed by the layer of varnish applied by the first varnishing unit 31 and no ink contamination takes place.

One will further appreciate that, according to the above-discussed embodiments of the invention, the printing press is configured such that the varnishing units of the recto side (i.e. unit 31 in FIGS. 1, 2 and units 31, 31* in FIG. 3) are accessible by an operator from a first working space WS1 located upstream of the varnishing group 03, 03*, between the numbering group 02 and the varnishing group 03, 03*. The varnishing units of the verso side (i.e. unit 32 in FIGS. 1, 2 and units 32, 32* in FIG. 3) are accessible by an operator from a second working space WS2 located downstream of the varnishing group 03, 03*. The configuration of the varnishing group 03, 03* is therefore such that access to the relevant components of the varnishing group is facilitated and not compromised. Such access is further facilitated by the fact that the sheets are transported from the numbering group 02 to the varnishing group 03, 03* by means of the sheet gripper system 05 running along a floor part of the printing press.

Various modifications and/or improvements may be made to the above-described embodiments without departing from the scope of the invention as defined by the annexed claims. For instance, the invention is equally applicable to the processing of printed material in the form of individual sheets or of successive portions of a continuous web.

Figure 4:
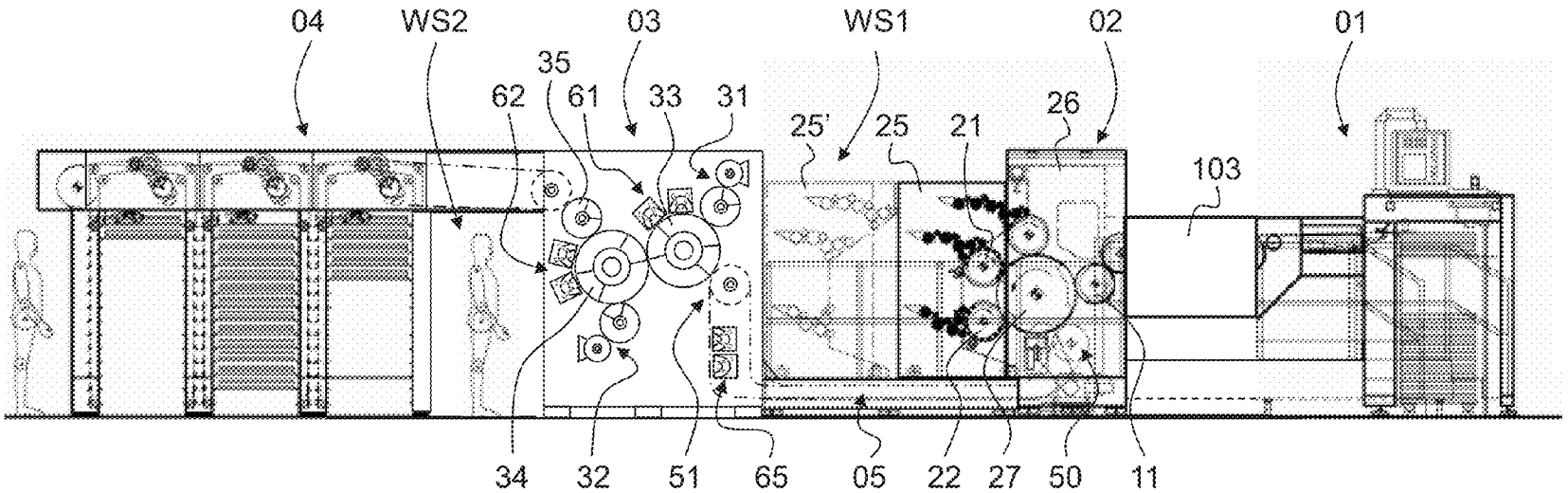
FIG. 4 is a schematic side view illustrating a modification of the printing press of FIG. 1.

In addition, the printing press may be modified to additionally include an inspection group 103 placed upstream of the numbering group 02 (as schematically shown in FIG. 4) for carrying out inspection of the printed material and determining occurrence of defects affecting the quality of the printed material prior to numbering and varnishing. Such an inspection group 103 may be an inspection group as disclosed in International Publication Nos. WO 2005/008605 A1 and WO 2005/008606 A1, both in the name of the present Applicant and incorporated herein by reference.

Additional printing or processing units may be provided, such as for instance a laser marking unit, which laser marking unit could be located upstream of the varnishing group for applying laser markings on the printed material prior to varnishing thereof or downstream of the varnishing group for applying laser markings through or into the layer or layers of varnish applied by the varnishing group.

LIST OF REFERENCES USED IN THE FIGURES AND SPECIFICATION

01 sheet-feeder
02 numbering group
03 varnishing group (FIGS. 1, 2)
03* varnishing group (FIG. 3)
04 sheet-delivery system
05 intermediate sheet gripper system comprising endless chains and space-apart gripper bars mounted transversely to the path of the sheets, between the endless chains, for holding the sheets by a leading edge thereof
11 sheet transfer cylinder or drum for transfer of successive sheets from sheet-feeder 01 to numbering group 02
21 (first) numbering unit/cylinder of numbering group 02
22 (second) numbering unit/cylinder of numbering group 02
25 mobile (inking) carriage of numbering group 02 (in working position)
25' mobile (inking) carriage of numbering group 02 (in retracted position for maintenance)
26 stationary part (printing unit) of numbering group 02

27 transport (impression) cylinder of numbering group 02
31 first varnishing unit (flexographic unit) for varnishing of recto side of the sheets
32 second varnishing unit (flexographic unit) for varnishing of verso side of the sheets
31* third varnishing unit (flexographic unit) for varnishing of recto side of the sheets (FIG. 3)
32* fourth varnishing unit (flexographic unit) for varnishing of verso side of the sheets (FIG. 3)
33 first cylinder or drum cooperating with first varnishing unit 31
34 second cylinder or drum cooperating with second varnishing unit 32
35 transfer cylinder for transferring of varnished sheets from second cylinder or drum 34 to sheet-delivery system 04 (and for optional inspection of recto side of the sheets or potentially designed as chill roller to cool down the sheets)
36 (optional) transfer cylinder or drum for transfer of the sheets to the sheet-delivery system 04 (e.g. for inspection of verso side of the sheets)
37 (optional) transfer cylinder or drum for transfer of the sheets to the sheet-delivery system 04 (potentially designed as chill roller to cool down the sheets)
50 upstream end of intermediate sheet gripper system 05 where the sheets are taken away from the numbering group 02
51 downstream end of intermediate sheet gripper system 05 where the sheets are delivered to the varnishing group 03
61 first drying unit (UV-curing unit) for drying/curing the recto side of the sheets following varnishing by the first varnishing unit 31 prior to transfer of the sheets to the second cylinder or drum 34
62 second drying unit (UV-curing unit) for drying/curing the verso side of the sheets following varnishing by the second varnishing unit 32
65 intermediate UV-curing unit for curing the sheets along the path of the sheets between the numbering group 02 and varnishing group 03 (in case of numbering with UV-curable inks)
101 camera (optional) for inspection of recto side of sheets (including numbering)
102 camera (optional) for inspection of verso side of sheets
103 inspection group placed upstream of the numbering group 02
310 anilox roller of first varnishing unit 31
311 forme cylinder of first varnishing unit 31
320 anilox roller of second varnishing unit 32
321 forme cylinder of second varnishing unit 32
310* anilox roller of third varnishing unit 31* (FIG. 3)
311* forme cylinder of third varnishing unit 31* (FIG. 3)
320* anilox roller of fourth varnishing unit 32* (FIG. 3)
321* forme cylinder of fourth varnishing unit 32* (FIG. 3)
WS1 working space for access to first varnishing unit 31 (and optional additional varnishing unit(s))
WS2 working space for access to second varnishing unit 32 (and optional additional varnishing unit(s))

The invention claimed is:

1. A sheet-fed printing press for numbering and varnishing of security documents, including banknotes, comprising:

a numbering group comprising at least one numbering unit for numbering printed material in the form of individual sheets carrying multiple security imprints; and a varnishing group located downstream of the numbering group for applying varnish onto recto and verso sides of the printed material, the varnishing group comprising at least a first varnishing unit disposed above a path of the printed material to apply varnish on the recto side of the printed material and at least a second varnishing unit disposed below the path of the printed material to apply varnish on the verso side of the printed material, wherein the printing press is adapted for processing printed material in the form of individual sheets and further comprises:

a sheet-feeder for feeding individual sheets in succession to the numbering group; and a sheet-delivery system for collecting varnished sheets coming from the varnishing group, wherein the numbering group is coupled to the varnishing group by means of an intermediate sheet gripper system comprising endless chains and space-apart gripper bars mounted transversely to the path of the sheets, between the endless chains, for holding the sheets by a leading edge of the sheets and transporting the sheets from the numbering group to the varnishing group.

2. The printing press as defined in claim 1, wherein the numbering group further comprises a movable carriage that can be retracted away from or be coupled to a stationary part of the numbering group.

3. The printing press as defined in claim 2, wherein the movable carriage is a movable inking carriage.

4. The printing press as defined in claim 2, wherein the intermediate sheet gripper system runs below the movable carriage.

5. The printing press as defined in claim 1, wherein the printing press is provided with at least one transfer cylinder or drum located between the varnishing group and the sheet-delivery system, which at least one transfer cylinder or drum is designed as a chill roller to cool down the printed material or as an inspection cylinder or drum for carrying out inspection of the recto or verso side of the printed material.

6. The printing press as defined in claim 1, wherein the numbering group and varnishing group are constructed as modular groups that can easily be decoupled from one another.

7. The printing press as defined in claim 1, wherein the numbering group and varnishing group are constructed as modular groups that can easily be decoupled from one another and wherein transfer of a sheet to the numbering group is performed by means of a sheet transfer cylinder or drum cooperating with a transport cylinder of the numbering group and wherein transfer of a sheet from the intermediate sheet gripper system to the varnishing group is performed at a location which corresponds in height to a location where the sheet is transferred from the transfer cylinder or drum to the transport cylinder of the numbering group.

8. The printing press as defined in claim 1, wherein numbering is carried out in the numbering group on a recto side of the printed material and wherein the numbered printed material is transferred directly to the varnishing group for varnishing of the recto side of the printed material by the at least first varnishing unit and, immediately after varnishing of the recto side, for varnishing of the verso side of the printed material by the at least second varnishing unit.

9. The printing press as defined in claim 8, wherein the numbering group is adapted to number the printed material on the recto side thereof with at least one ink selected from the group consisting of oxidative solvent-based inks and UV-curable inks.

10. The printing press as defined in claim 8, wherein the recto side of the printed material is not dried before being varnished by the at least first varnishing unit.

11. The printing press as defined in claim 1, wherein the at least first and second varnishing units are flexographic varnishing units each comprising an anilox roller inked by an associated ink chamber, which anilox roller cooperates with a flexographic forme cylinder.

12. The printing press as defined in claim 1, further comprising an inspection group placed upstream of the numbering group for carrying out inspection of the printed material and determining occurrence of defects affecting the quality of the printed material prior to numbering and varnishing.

13. The printing press as defined in claim 1, further comprising an intermediate UV-curing unit for curing the printed material, which intermediate UV-curing unit is located along the path of the printed material between the numbering group and varnishing group.

14. The printing press as defined in claim 1, wherein the printing press is configured such that the at least first varnishing unit is accessible by an operator from a first working space located upstream of the varnishing group, between the numbering group and the varnishing group, and such that the at least second varnishing unit is accessible by an operator from a second working space located downstream of the varnishing group.

15. A sheet-fed printing press for numbering and varnishing of security documents, including banknotes, comprising:

a sheet-feeder for feeding in succession printed material in the form of individual sheets carrying multiple security imprints;

a numbering group comprising at least one numbering unit for numbering the sheets;

a varnishing group located downstream of the numbering group for applying varnish onto recto and verso sides of the sheets, the varnishing group comprising at least a first varnishing unit for applying varnish on the recto side of the sheets and at least a second varnishing unit for applying varnish on the verso side of the sheets; and a sheet-delivery system for collecting varnished sheets coming from the varnishing group, wherein the numbering group is coupled to the varnishing group by means of an intermediate sheet gripper system comprising endless chains and space-apart gripper bars mounted transversely to the path of the sheets, between the endless chains, for holding the sheets by a leading edge of the sheets and transporting the sheets from the numbering group to the varnishing group.

16. The printing press as defined in claim 15, wherein the numbering group further comprises a movable carriage that can be retracted away from or be coupled to a stationary part of the numbering group.

17. The printing press as defined in claim 16, wherein the movable carriage is a movable inking carriage.

18. The printing press as defined in claim 16, wherein the intermediate sheet gripper system runs below the movable carriage.

19. The printing press as defined in claim 15, wherein the printing press is provided with at least one transfer cylinder or drum located between the varnishing group and the sheet-delivery system, which at least one transfer cylinder or drum is designed as a chill roller to cool down the printed material or as an inspection cylinder or drum for carrying out inspection of the recto or verso side of the printed material.

20. The printing press as defined in claim 15, wherein the numbering group and varnishing group are constructed as modular groups that can easily be decoupled from one another.

21. The printing press as defined in claim 15, wherein the numbering group and varnishing group are constructed as modular groups that can easily be decoupled from one another and wherein transfer of a sheet to the numbering group is performed by means of a sheet transfer cylinder or drum cooperating with a transport cylinder of the numbering group and wherein transfer of a sheet from the intermediate sheet gripper system to the varnishing group is performed at a location which corresponds in height to a location where the sheet is transferred from the transfer cylinder or drum to the transport cylinder of the numbering group.

22. The printing press as defined in claim 15, wherein numbering is carried out in the numbering group on a recto side of the printed material and wherein the numbered printed material is transferred directly to the varnishing group for varnishing of the recto side of the printed material by the at least first varnishing unit and, immediately after varnishing of the recto side, for varnishing of the verso side of the printed material by the at least second varnishing unit.

23. The printing press as defined in claim 22, wherein the numbering group is adapted to number the printed material on the recto side thereof with at least one selected from the group consisting of oxidative solvent-based inks and UV-curable inks.

24. The printing press as defined in claim 22, wherein the recto side of the printed material is not dried before being varnished by the at least first varnishing unit.

25. The printing press as defined in claim 15, wherein the varnishing group comprises:

a first cylinder or drum located below the path of the printed material and cooperating with the at least first varnishing unit which is disposed above the path of the printed material; and a second cylinder or drum located above the path of the printed material and cooperating with the at least second varnishing unit which is disposed below the path of the printed material, the second cylinder or drum being located immediately after the first cylinder or drum to ensure direct transfer of the printed material from the first cylinder or drum to the second cylinder or drum.

26. The printing press as defined in claim 25, wherein the first and second cylinders or drums are two-segment cylinders or drums.

27. The printing press as defined in claim 25, wherein the varnishing group further comprises:

a third varnishing unit which cooperates with the first cylinder or drum and is located immediately after the first varnishing unit, and a fourth varnishing unit which cooperates with the second cylinder or drum and is located immediately after the second varnishing unit.

28. The printing press as defined in claim 25, further comprising at least a first drying unit cooperating with the first cylinder or drum for drying the recto side of the printed material following varnishing by the at least first varnishing unit prior to transfer of the printed material to the second cylinder or drum and at least a second drying unit cooperating with the second cylinder or drum for drying the verso side of the printed material following varnishing by the at least second varnishing unit.

29. The printing press as defined in claim 28, wherein the at least first and second varnishing units are designed to apply UV-curable varnish on the recto and verso sides of the printed material and wherein the first and second drying units are UV-curing units.

30. The printing press as defined in claim 15, wherein the at least first and second varnishing units are flexographic varnishing units each comprising an anilox roller inked by an associated ink chamber, which anilox roller cooperates with a flexographic forme cylinder.

31. The printing press as defined in claim 15, further comprising an inspection group placed upstream of the numbering group for carrying out inspection of the printed material and determining occurrence of defects affecting the quality of the printed material prior to numbering and varnishing.

32. The printing press as defined in claim 15, further comprising an intermediate UV-curing unit for curing the printed material, which intermediate UV-curing unit is located along the path of the printed material between the numbering group and varnishing group.

33. The printing press as defined in claim 15, wherein the printing press is configured such that the at least first varnishing unit is accessible by an operator from a first working space located upstream of the varnishing group, between the numbering group and the varnishing group, and such that the at least second varnishing unit is accessible by an operator from a second working space located downstream of the varnishing group.

34. A sheet-fed or web-fed printing press for numbering and varnishing of security documents, including banknotes, comprising:

a numbering group comprising at least one numbering unit for numbering printed material in the form of individual sheets or successive portions of a continuous web carrying multiple security imprints; and a varnishing group located downstream of the numbering group for applying varnish onto recto and verso sides of the printed material, the varnishing group comprising at least a first varnishing unit disposed above a path of the printed material to apply varnish on the recto side of the printed material and at least a second varnishing unit disposed below the path of the printed material to apply varnish on the verso side of the printed material, wherein the varnishing group comprises:

a first cylinder or drum located below the path of the printed material and cooperating with the at least first varnishing unit which is disposed above the path of the printed material; and a second cylinder or drum located above the path of the printed material and cooperating with the at least second varnishing unit which is disposed below the path of the printed material, the second cylinder or drum being located immediately after the first cylinder or drum to ensure direct transfer of the printed material from the first cylinder or drum to the second cylinder or drum, and wherein the varnishing group further comprises:

a third varnishing unit which cooperates with the first cylinder or drum and is located immediately after the first varnishing unit, and a fourth varnishing unit which cooperates with the second cylinder of drum and is located immediately after the second varnishing unit.

35. The printing press as defined in claim 34, wherein the first and second cylinders or drums are two-segment cylinders or drums.

36. The printing press as defined in claim 34, further comprising at least a first drying unit cooperating with the first cylinder or drum for drying the recto side of the printed material following varnishing by the at least first varnishing unit prior to transfer of the printed material to the second cylinder or drum and at least a second drying unit cooperating with the second cylinder or drum for drying the verso side of the printed material following varnishing by the at least second varnishing unit.

37. The printing press as defined in claim 36, wherein the at least first and second varnishing units are designed to apply UV-curable varnish on the recto and verso sides of the printed material and wherein the first and second drying units are UV-curing units.

* * * * *